US008319790B2

(12) United States Patent
Ho et al.

(10) Patent No.: US 8,319,790 B2
(45) Date of Patent: Nov. 27, 2012

(54) COLOR ADJUSTMENT CIRCUIT, DIGITAL COLOR ADJUSTMENT DEVICE AND MULTIMEDIA APPARATUS USING THE SAME

(75) Inventors: Chao-Wei Ho, Hsinchu County (TW); Chung-Yu Ke, Kaohsiung (TW); Tung-Lin Wu, Taoyuan County (TW); Chia-Hsien Cheng, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 1286 days.

(21) Appl. No.: 11/613,197

(22) Filed: Dec. 20, 2006

(65) Prior Publication Data

US 2008/0079968 A1 Apr. 3, 2008

(30) Foreign Application Priority Data

Sep. 25, 2006 (TW) ..... 95135346 A

(51) Int. Cl.
*G09G 5/06* (2006.01)

(52) U.S. Cl. ..... 345/602

(58) Field of Classification Search ..... 345/600–604
See application file for complete search history.

(56) References Cited

U.S. PATENT DOCUMENTS 5,068,644 A * 11/1991 Batson et al. ..... 345/601
5,742,296 A * 4/1998 Yamada et al. ..... 345/604
6,122,012 A 9/2000 Segman
6,791,716 B1 9/2004 Buhr et al.
7,023,582 B2 * 4/2006 Sawada et al. ..... 358/1.9
2002/0060796 A1 * 5/2002 Kanno et al. ..... 358/1.9
2003/0038996 A1 2/2003 Sawada et al.
2004/0021671 A1 * 2/2004 Leyvi ..... 345/589
2004/0032671 A1 2/2004 Wada et al.

FOREIGN PATENT DOCUMENTS

CN 1510929 7/2004
JP 5-42754 A * 2/1993
JP 2005-102237 A * 4/2005
JP 2005-102238 A * 4/2005
WO WO 2004/008778 1/2004

OTHER PUBLICATIONS

"Office Action of Taiwan Counterpart Application", issued on Apr. 28, 2010, p. 1-p. 7.
"Office Action of Taiwan counterpart application" issued on Apr. 28, 2010, p. 1-p. 7, in which US5742296 was cited.

* cited by examiner

*Primary Examiner* — Jeffery A Brier
(74) *Attorney, Agent, or Firm* — Jianq Chyun IP Office

(57) ABSTRACT

A digital color adjustment device for a multimedia apparatus is provided. The digital color adjustment device performs color adjustment on a received pixel color data and sends to a display unit of the multimedia apparatus for display. The digital color adjustment device includes a hue shift lookup table, a saturation mapping lookup table, a brightness transformation lookup table and a non-linear output lookup table. The digital color adjustment device performs gamut mapping non-linear adjustment and/or independent color non-linear adjustment.

3 Claims, 19 Drawing Sheets

Gamut mapping

| Color axis | Hue shift | Saturation gain | Brightness gain | Layer 1 | Layer 2 | Layer 3 | Layer 4 | Layer 5 |
|---|---|---|---|---|---|---|---|---|
| 0 (Red) | 10 | 1 | 1.1 | 1(0) | 1.2(77) | 1(128) | 1.2(230) | 1(255) |
| 60 (Yellow) | 0 | 1.2 | 1 | 1(0) | 1(64) | 1(128) | 1(192) | 1(255) |
| 120 (Green) | −10 | 1 | 1 | 1(0) | 1(64) | 1(128) | 1(192) | 1(255) |
| 180 (Cyan) | 0 | 0.8 | 1 | 1(0) | 1(64) | 1(128) | 1(192) | 1(255) |
| 240 (Blue) | 0 | 1 | 0.9 | 1(0) | 1(64) | 1(128) | 1(192) | 1(255) |
| 300 (Purple) | 0 | 1 | 1 | 1(0) | 1(64) | 1(128) | 1(192) | 1(255) |
| | | | | | | | | |
| | | | | | | | | |
| | | | | | | | | |
| | △H | Gc | Gy | Gy(Yy) | Gy(Yy) | Gy(Yy) | Gy(Yy) | Gy(Yy) |

Hue shift

Saturation gain

Brightness gain

FIG. 8

Independent color adjustment

| Color axis | Hue shift | Saturation gain | Brightness gain | Layer 1 | Layer 2 | Layer 3 | Layer 4 | Layer 5 |
|---|---|---|---|---|---|---|---|---|
| 18 (Skin color) | 5 | 1.4 | 1.2 | 1(0) | 1.2(77) | 1.2(154) | 1.2(230) | 1(255) |
| 212 (Sky color) | −5 | 1.2 | 0.9 | 1(0) | 1(64) | 0.9(115) | 0.9(173) | 1(255) |
| | | | | | | | | |
| | | | | | | | | |
| | | | | | | | | |
| | | | | | | | | |
| | | | | | | | | |
| | | | | | | | | |

ΔH Gc Gy Gy(Yy) Gy(Yy) Gy(Yy) Gy(Yy) Gy(Yy)

Hue shift

Saturation gain

Brightness gain

FIG. 12

COLOR ADJUSTMENT CIRCUIT, DIGITAL COLOR ADJUSTMENT DEVICE AND MULTIMEDIA APPARATUS USING THE SAME

CROSS-REFERENCE TO RELATED APPLICATION

This application claims the priority benefit of Taiwan application serial no. 95135346, filed on Sep. 25, 2006. All disclosure of the Taiwan application is incorporated herein by reference.

BACKGROUND OF THE INVENTION

1. Field of Invention

The present invention relates to a color adjustment method and device for a multimedia apparatus, and more particularly, to a color adjustment method and device for providing gamut mapping non-linear adjustment and/or independent color non-linear adjustment.

2. Description of Related Art

The color adjustment for current multimedia apparatuses (such as display devices, TV sets, digital cameras, digital video cameras) includes gamut mapping and user preferred color adjustment. The so-called gamut mapping includes reducing or increasing the saturation of red and green colors, or moving the hue-chroma of the yellow color. The user preferred color adjustment indicates separately adjusting an independent color such as the color of grass, sky, and skin, without affecting other colors.

Restricted by the overall hue, saturation and brightness adjustments, a common display cannot provide the color adjustment of an individual hue. Some high-level displays provide advanced six-axial hue adjustment and brightness (gamma) adjustment, and enhance the adjustment of a specific independent color.

Taking the current color adjustment technology as an example, the RGB (red, green, blue) color information in the image is transformed into RGBCMY (red, green, blue, cyan, magenta, yellow) six-color information. Then, the saturation/intensity adjustment is performed through a six-color lookup table and a color control circuit. Finally, the result is transformed into a YCbCr signal to be outputted. The six-color lookup table is established based upon the relationship between an original image and an adjusted target image.

Furthermore, in another conventional art, the RGB color space is transformed into a CIELab color space, and then transformed into lightness-chroma-hue (LCH) color space. Then, the default user preferred color is obtained by performing a continuous and smooth chroma transformation within a default color range. However, the disadvantage lies in that the hardware architecture is complicated and high cost.

However, the above current technology cannot provide an optimal and consistent output result. Furthermore, the current color adjustment cannot provide independent color non-linear adjustment.

SUMMARY OF THE INVENTION

In view of the above, the present invention is directed to providing a color adjustment method and device for a multimedia apparatus, which is used for achieving gamut mapping non-linear adjustment and/or independent color non-linear adjustment.

The present invention is also directed to providing a color adjustment method and device for a multimedia apparatus, which has software and hardware with a high feasibility.

The present invention is also directed to providing a color adjustment method and device for a multimedia apparatus, wherein the color adjustment is relatively simple without any complicated operations, which can meet the real-time requirement.

The present invention is also directed to providing a color adjustment method and device for a multimedia apparatus, which achieves an excellent effect in the color adjustment.

The present invention is also directed to providing a color adjustment method and device for a multimedia apparatus, which has a 3D color adjustment capability.

The present invention provides a multimedia apparatus, which comprises: a digital color adjustment device used for receiving a first image color data generated by a driving circuit, and utilizing a hue shift lookup table, a saturation mapping lookup table, a brightness transformation lookup table and a non-linear output lookup table to perform a color adjustment on the first image color data into a second image color data, and sending it to a display unit for display; and a user control interface used for generating an adjustment value in response to a display image displayed by the display unit, wherein the adjustment value is relevant to the establishment of the above lookup tables.

The digital color adjustment device comprises: a color transformation circuit, used for receiving the first image color data and performing a color transformation on the first image color data to obtain a third image color data; a hue transformation circuit, used for receiving the third image color data and performing a hue transformation on the third image color data to obtain a fourth image color data; a color adjustment circuit, comprising the hue shift lookup table, the saturation mapping lookup table, the brightness transformation lookup table and the non-linear output lookup table, and used for performing a color adjustment on the fourth image color data to obtain a fifth image color data according to the above lookup tables; and a reverse hue transformation circuit, used for receiving the fifth image color data and performing a reverse hue transformation on the fifth image color data to obtain a sixth image color data; and a reverse color transformation circuit, used for receiving the sixth image color data and performing a reverse color transformation on the sixth image color data to obtain the second image color data.

The color adjustment circuit comprises: the hue shift lookup table, used for obtaining a hue shift signal according to a hue signal; a first adder, used for adding the hue signal with the hue shift signal to obtain an adjusted hue signal; the saturation mapping lookup table, used for obtaining a saturation mapping signal according to the hue signal; a first multiplier, used for multiplying the saturation signal with the saturation mapping signal to obtain a first multiplication result; the brightness transformation lookup table, used for obtaining a brightness gain signal according to the hue signal; a second multiplier, for multiplying the brightness signal with the brightness gain signal to obtain a second multiplication result; the non-linear output lookup table, used for obtaining a brightness upper limit signal and a saturation upper limit signal according to the brightness signal and the saturation signal; a first selecting unit, used for producing an adjusted saturation signal according to the saturation upper limit signal and the first multiplication result; and a second selecting unit, used for producing an adjusted brightness signal according to the brightness upper limit signal and the second multiplication result.

Alternatively, the color adjustment circuit comprises: the hue shift lookup table, used for obtaining a hue shift signal according to a hue signal; a second adder, used for adding the hue signal with the hue shift signal to obtain an adjusted hue signal; the saturation mapping lookup table, used for obtaining a saturation mapping signal according to the hue signal; a third multiplier, used for multiplying the saturation signal with the saturation mapping signal into a third multiplication result; the brightness transformation lookup table, used for obtaining a brightness gain signal according to the hue signal and the brightness signal; a fourth multiplier, used for multiplying the brightness signal with the brightness gain signal to obtain a fourth multiplication result; the non-linear output lookup table, used for obtaining a brightness upper limit signal and a saturation upper limit signal according to the brightness signal and the saturation signal; a third selecting unit, used for producing an adjusted saturation signal according to the saturation upper limit signal and the third multiplication result; and a fourth selecting unit, used for producing an adjusted brightness signal according to the brightness upper limit signal and the fourth multiplication result.

Alternatively, the color adjustment circuit comprises: the hue shift lookup table, used for obtaining a hue shift signal according to a hue signal; a third adder, used for adding the hue signal with the hue shift signal to obtain an adjusted hue signal; the saturation mapping lookup table, used for obtaining a saturation mapping signal according to the hue signal; a fifth multiplier, used for multiplying the saturation signal with the saturation mapping signal to obtain a fifth multiplication result; the brightness transformation lookup table, used for obtaining a transformation brightness signal according to the hue signal and the brightness signal; the non-linear output lookup table, used for obtaining a brightness upper limit signal and a saturation upper limit signal according to the brightness signal and the saturation signal; a fifth selecting unit, used for producing an adjusted saturation signal according to the saturation upper limit signal and the fifth multiplication result; and a sixth selecting unit, used for producing an adjusted brightness signal according to the brightness upper limit signal and the transformation brightness signal.

In order to make the aforementioned and other objectives, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIGS. 8, 9, 10*a* to 10*c*, and 11*a* to 11*b* respectively show a user control interface, a software interface related to the non-linear output lookup table, the hue shift lookup table, the saturation mapping lookup table, and the brightness transformation lookup table during the gamut mapping adjustment.

FIGS. 12, 13, 14*a* to 14*c*, 15*a* to 15*b*, and 16*a* to 16*b* respectively show a user control interface, a software interface related to the non-linear output lookup table, the hue shift lookup table, the saturation mapping lookup table, and the brightness transformation lookup table during the independent color adjustment.

DESCRIPTION OF EMBODIMENTS

To further understand the content of the present invention, the embodiments are given below as the exemplary examples for implementing the present invention.

The present invention provides a digital color adjustment method and device for a multimedia apparatus (such as display devices, TV sets, digital cameras, digital video cameras) in the embodiment. The digital color adjustment device receives the pixel color data sent by the driving circuit, and then, conducts a digital color adjustment to the pixel color data and then sends it to the display unit of the multimedia apparatus for being displayed. The digital color adjustment device includes an independent color adjustment hue shift lookup table, a multi-hue saturation mapping lookup table, a multi-layer brightness transformation lookup table and a non-linear output lookup table. The digital color adjustment device separately or simultaneously performs the gamut mapping of the optimal color characteristics, and the independent color adjustment for adjusting the user preferred colors according to actual requirements. The user views or measures the adjustment pattern on the display unit for inputting an adjustment value. A continuous adjustment curve of the lookup table can be established according to the adjustment value. The continuous adjustment curve can be established by means of software or hardware. Therefore, the effect of gamut mapping non-linear adjustment and independent color non-linear adjustment can be achieved.

Figure 1:
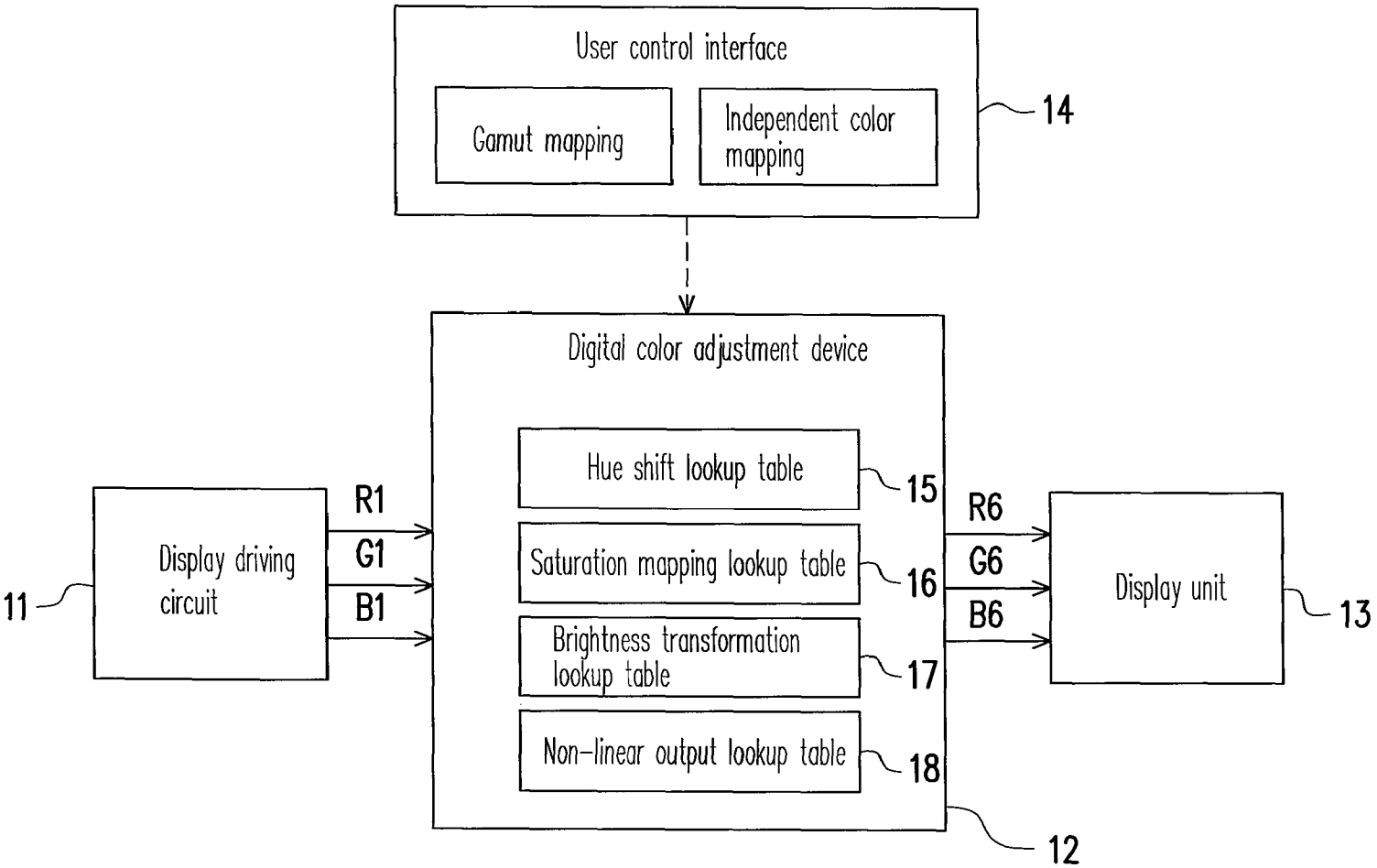
FIG. 1 is a schematic circuit view of an embodiment of the present invention.

FIG. 1 is a schematic circuit view of an embodiment of the present invention. As shown in FIG. 1, the driving circuit 11 sends a pixel color data R1G1B1 to the digital color adjustment device 12. The digital color adjustment device 12 performs a digital color adjustment according to a hue shift lookup table 15, a saturation mapping lookup table 16, a brightness transformation lookup table 17 and a non-linear output lookup table 18 therein, so as to obtain a pixel color data R6G6B6. The pixel color data R6G6B6 is sent to the display unit 13 for being displayed.

The user views or measures the adjustment pattern on the display unit for inputting an adjustment value. The continuous adjustment curve of the lookup tables 15-18 can be established according to the adjustment value inputted by the user, so as to achieve the gamut mapping and independent color non-linear adjustment. The user inputs the adjustment value via the user control interface 14, and then, inputs the adjustment value or the established lookup table into the digital color adjustment device 12.

Figure 2:
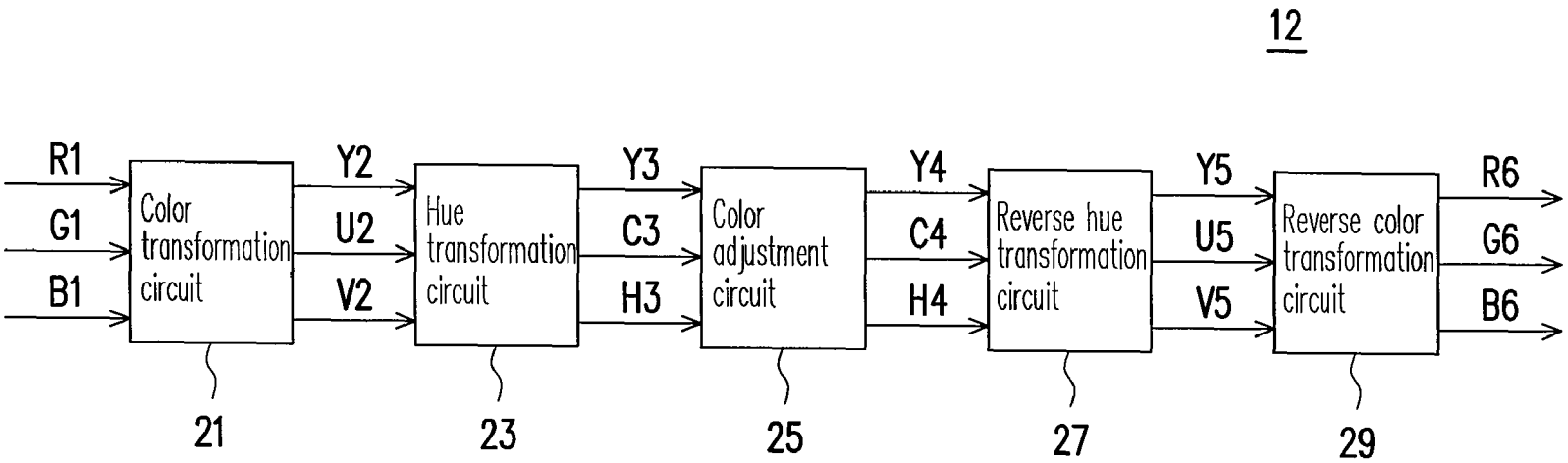
FIG. 2 is a circuit block diagram of a digital color adjustment device.

FIG. 2 is a circuit block diagram of the digital color adjustment device 12. The digital color adjustment device 12 includes: a color transformation circuit 21 used for transforming the pixel color data R1G1B1 into a TV signal Y2U2V2; a hue transformation circuit 23 used for transforming the TV signal Y2U2V2 into another color signal Y3C3H3; a color adjustment circuit 25 used for performing a color adjustment on the color signal Y3C3H3 to generate a color signal Y4C4H4; a reverse hue transformation circuit 27 used for transforming the color signal Y4C4H4 into a TV signal Y5U5V5; and a reverse color transformation circuit 29 used for transforming the TV signal Y5U5V5 into a pixel color data R6G6B6 and outputting it to the display unit 13 for being displayed. The above lookup tables 15-18 are included in the color adjustment circuit 25.

Furthermore, the TV signal YUV can be substituted by other color space signals, for example a (Y', B'-Y', R'-Y') signal or a YCbCr signal.

Figure 3A:
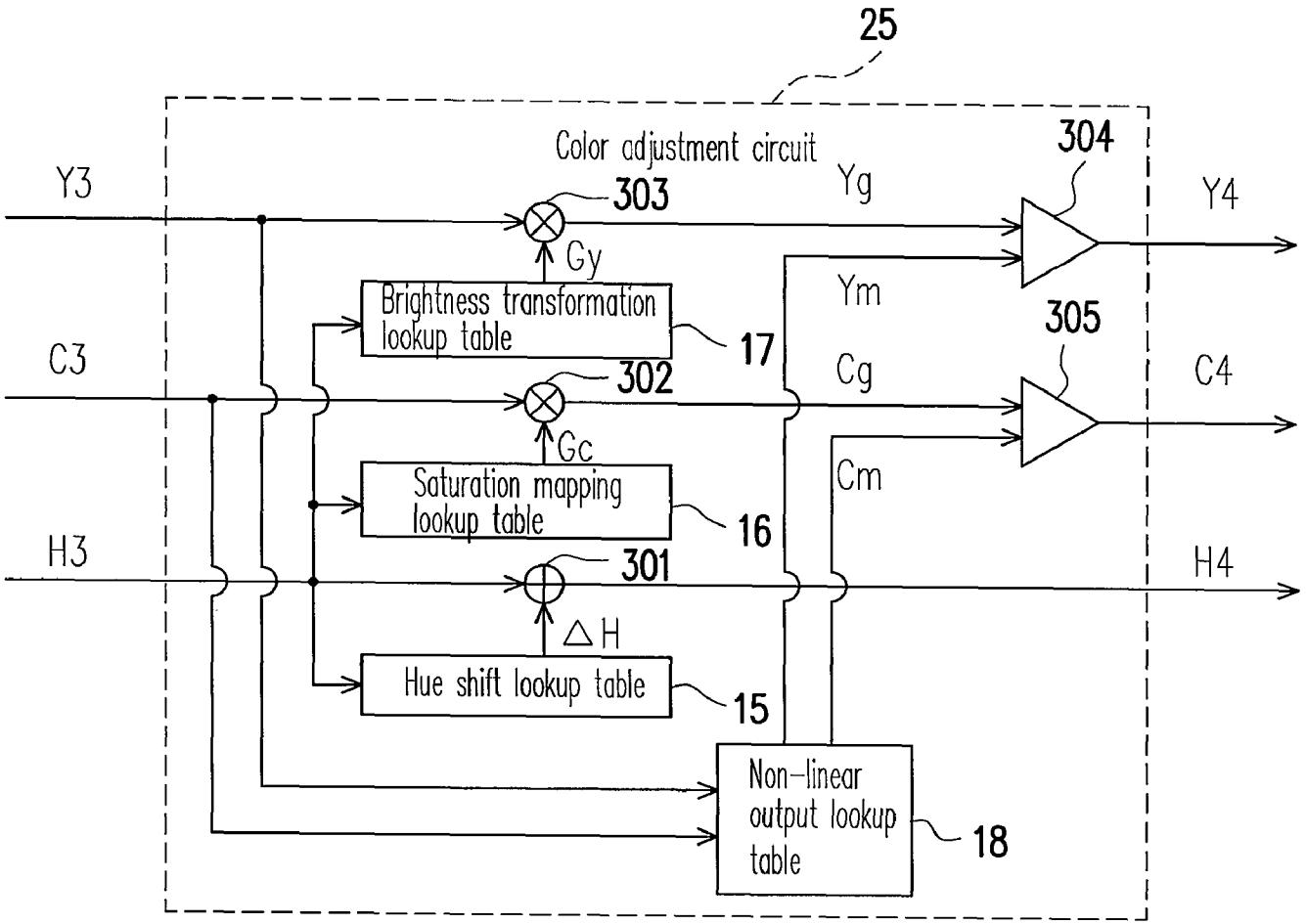
FIGS. 3*a* to 3*c* show three color adjustment methods performed by a color adjustment circuit 25.
Figure 3B:
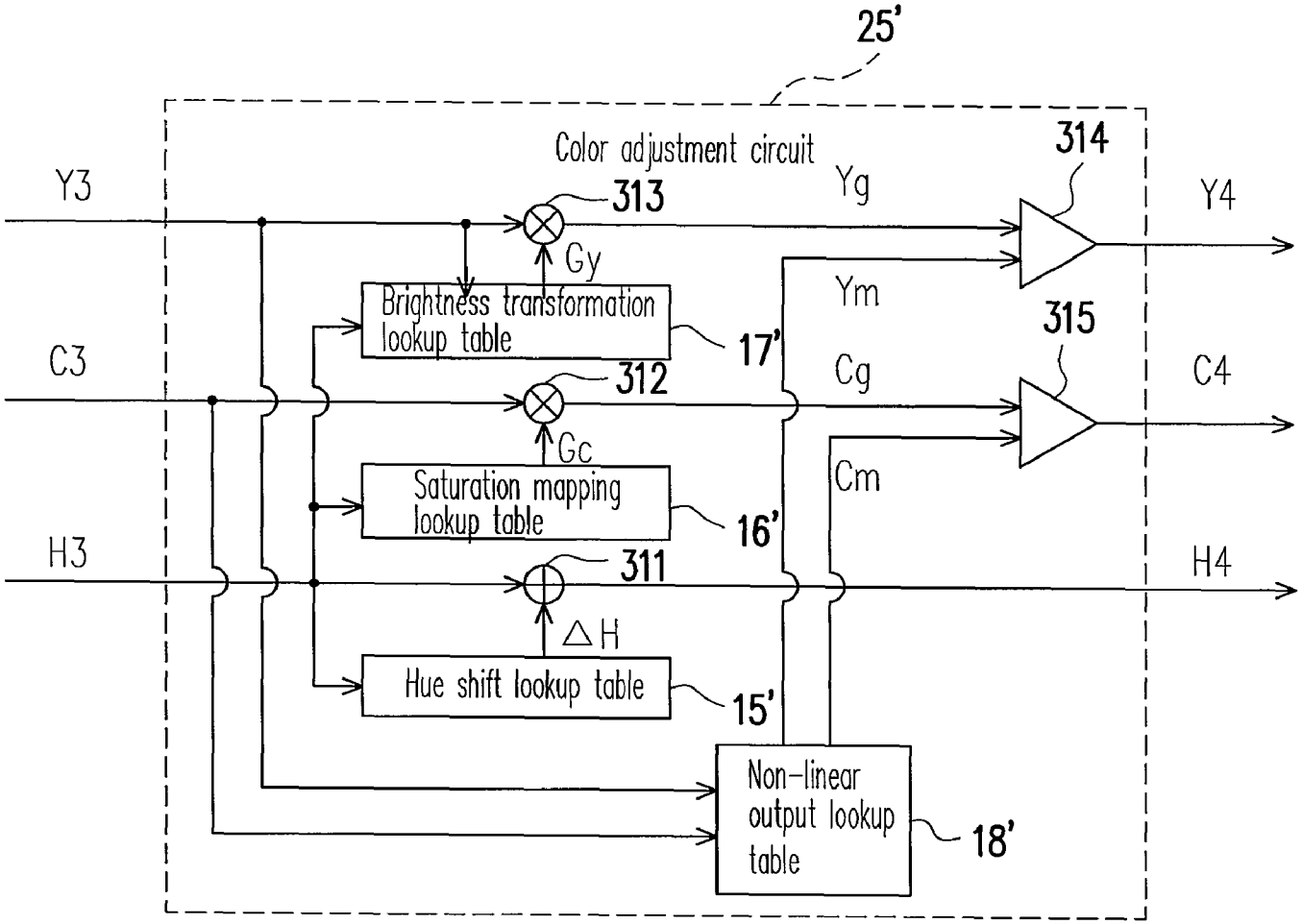
Figure 3C:
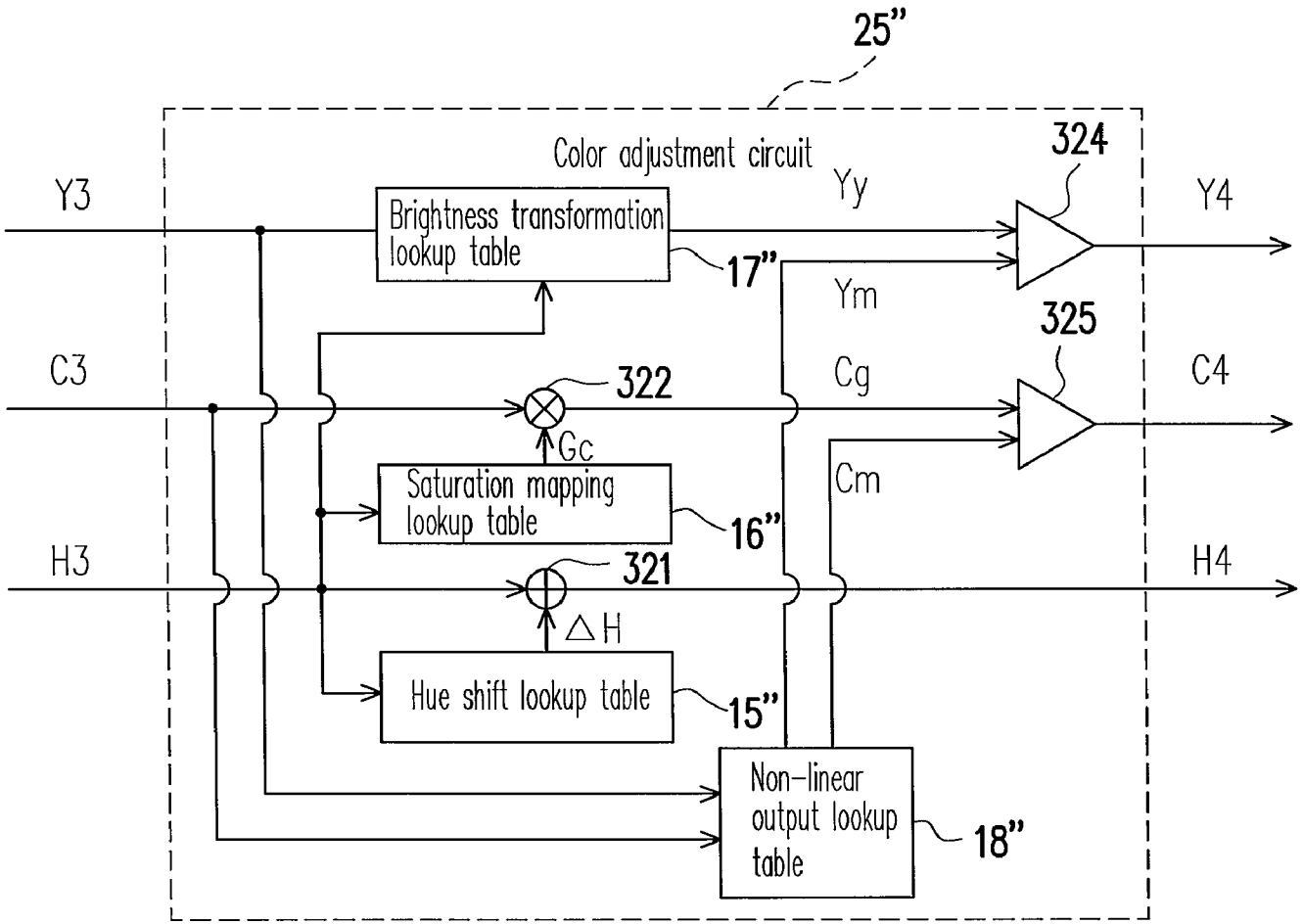

In this embodiment, the color adjustment circuit 25 may perform three color adjustment methods, which are shown in FIGS. 3*a*-3*c*, and certainly, the present invention is not limited to this.

The first color adjustment method is shown in FIG. 3*a*. A hue shift signal ΔH is obtained according to the hue signal H3 via the non-linear output lookup table 15, wherein $-180° \leqq \Delta H = \leqq 180°$. The adder 301 adds the hue shift signal ΔH with the hue signal H3 to obtain a hue signal H4. A saturation mapping signal Gc is obtained according to the hue signal H3, wherein $0.5 \leqq Gc \leqq 2$. The multiplier 302 multiplies the saturation mapping signal Gc with the saturation signal C3 to obtain another saturation signal Cg. A saturation upper limit signal Cm is obtained according to the saturation signal C3 via the non-linear output lookup table 18. The comparator 305 compares the saturation signal Cg with the saturation upper limit signal Cm, and then selects the smaller one as an adjusted saturation signal C4. Therefore, the saturation non-linear adjustment is achieved. A brightness gain value Gy is obtained according to the hue signal H3 via the brightness transformation lookup table 17, wherein $0.5 \leqq Gy \leqq 2$. The multiplier 303 multiplies the brightness gain value Gy with the brightness signal Y3 to obtain another brightness signal Yg. A brightness upper limit signal Ym is obtained according to the brightness signal Y3 via the non-linear output lookup table 18. The comparator 304 compares the brightness signal Yg with the brightness upper limit signal Ym, and then selects the smaller one as an adjusted brightness signal Y4, so as to achieve the brightness non-linear adjustment effect.

The second color adjustment method is shown in FIG. 3*b*. Basically, the difference between the first and second color adjustment methods at least lies in how to produce the brightness signal Y4. The methods for producing the hue signal H4 and the saturation signal C4 are similar, which thus will not be repeatedly described herein. The brightness gain value Gy of the hue in the brightness layers is obtained according to the hue signal H3 and the brightness signal Y3 via the brightness transformation lookup table 17', wherein $0.5 \leqq Gy \leqq 2$. The multiplier 313 multiplies the brightness gain value Gy with the brightness signal Y3 to obtain an adjusted brightness signal Yg. The comparator 314 compares the adjusted brightness signal Yg with the brightness upper limit signal Ym, and then selects the smaller one as a brightness signal Y4, so as to achieve the brightness non-linear adjustment.

The third color adjustment method is shown in FIG. 3*c*. Basically, the difference between the first and third color adjustment methods at least lies in how to produce the brightness signal Y4. The methods for producing the hue signal H4 and the saturation signal C4 are similar, which thus will not be repeatedly described herein. The transformation brightness value Yy of the hue in the brightness layers is obtained according to the hue signal H3 and the brightness signal Y3 via the brightness transformation lookup table 17", wherein $0 \leqq Yy \leqq$ the bit depth of the brightness signal. The comparator 324 compares the transformation brightness signal Yy with the brightness upper limit signal Ym, and then, selects the smaller one as a brightness signal Y4, so as to achieve the brightness non-linear adjustment.

Figure 5:
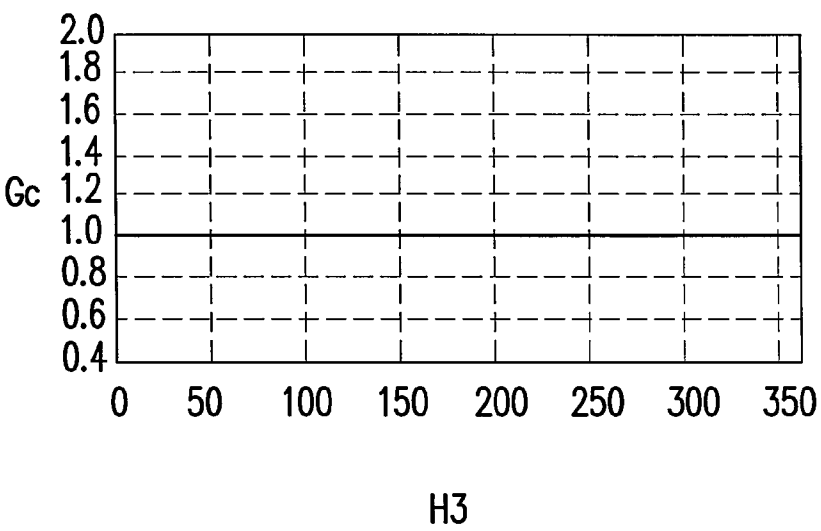
FIGS. 4 and 5 show initial states of a hue shift lookup table and a saturation mapping lookup table.
Figure 4:
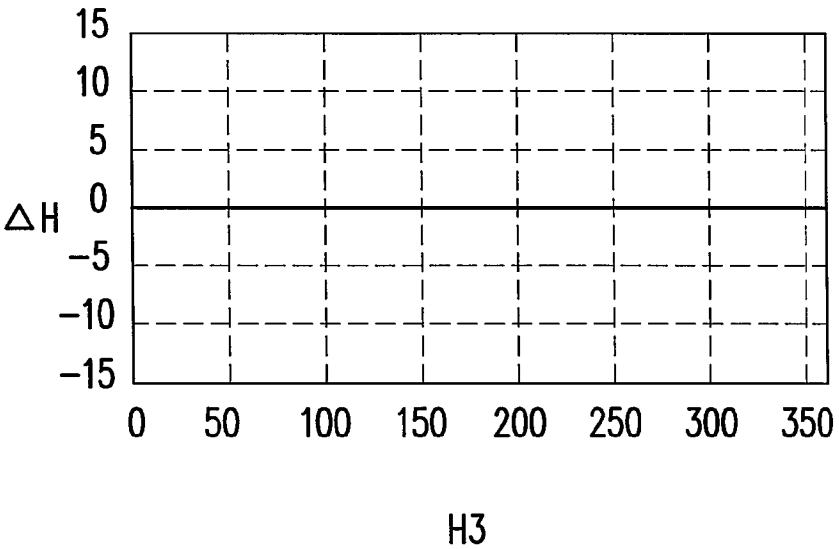

The initial states of the hue shift lookup tables and saturation mapping lookup tables of the above three color adjustment methods are shown in FIGS. 4 and 5. Since there are no hue and saturation variations in the initial states, ΔH is 0 and Gc is 1. At this time, no hue/saturation adjustment is performed on the color signal Y3C3H3. That is, the outputted pixel color data R6G6B6 equals to the inputted pixel color data R1G1B1.

Figure 6:
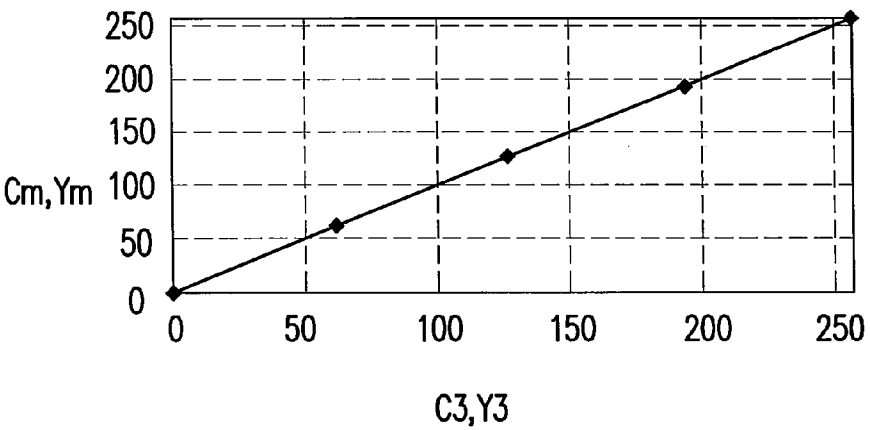
FIG. 6 shows the initial state of a non-linear output lookup table.

The initial states of the non-linear output lookup tables of the above three color adjustment methods are shown in FIG. 6. Since there is no non-linear adjustment in the initial state, no non-linear saturation/brightness adjustment is performed on the color signal Y3C3H3 at this time. That is, the outputted pixel color data R6G6B6 equals to the inputted pixel color data R1G1B1.

Figure 7A:
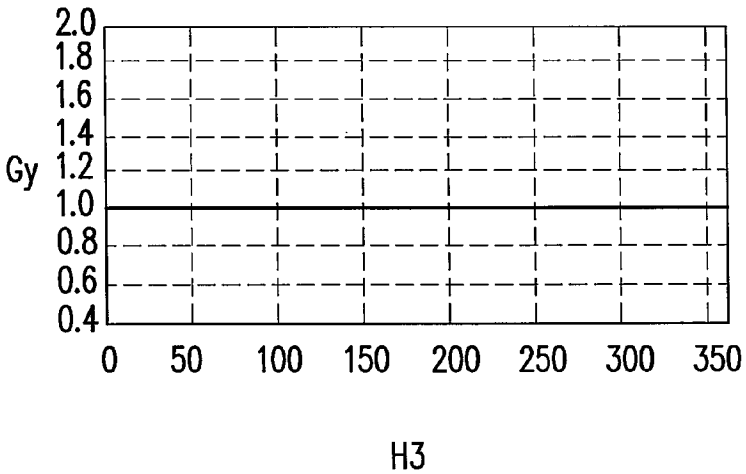
FIGS. 7*a* to 7*c* show the initial state of a brightness transformation lookup table.

The initial state of the brightness transformation lookup table of the first color adjustment method is shown in FIG. 7*a*. Since there is no brightness variation in the initial state, no brightness adjustment is performed on the color signal Y3C3H3 at this time. That is, the outputted pixel color data R6G6B6 equals to the inputted pixel color data R1G1B1.

Figure 7B:
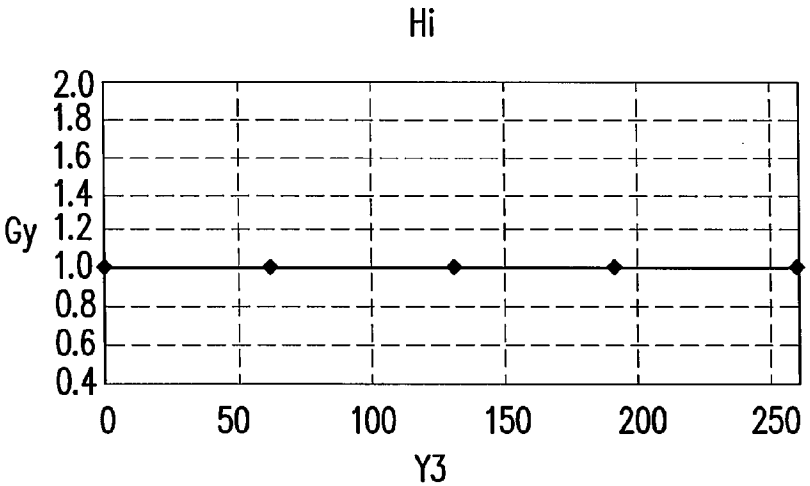
Figure 7C:
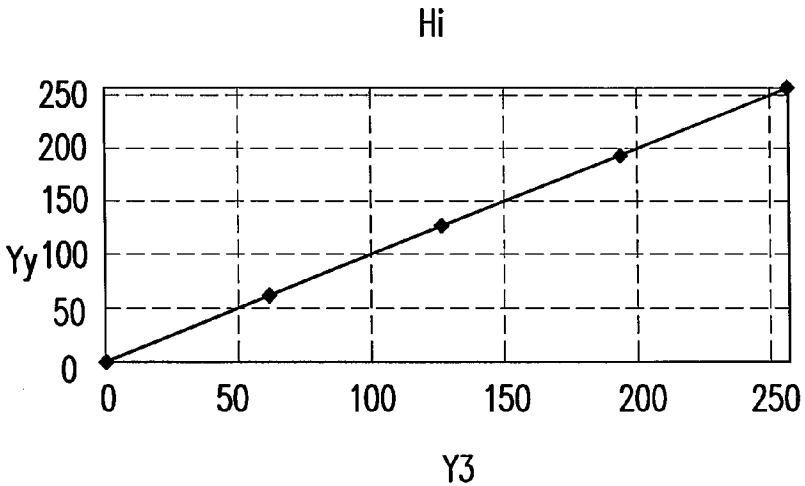

The initial states of the brightness transformation lookup tables of the second and third color adjustment methods are shown in FIGS. 7*b* and 7*c*, wherein the brightness layer is set to have 5 layers, and the inputted signal R/G/B is, for example, 8 bits. Therefore, the first layer is 0, the second layer is 64, the third layer is 128, the fourth layer is 192, and the fifth layer is 255. The brightness layers are preferably designed to be more than 3 layers. Since there is no brightness variation in the initial state, the brightness adjustment is not performed on the color signal Y3C3H3. That is, the outputted pixel color data R6G6B6 equals to the inputted pixel color data R1G1B1.

In this embodiment, the digital color adjustment has three types: (1) gamut mapping adjustment; (2) independent color adjustment; and (3) performing both the gamut mapping and independent color adjustments at the same time. The details are respectively given below:

(1) Gamut Mapping Adjustment

Figure 9:
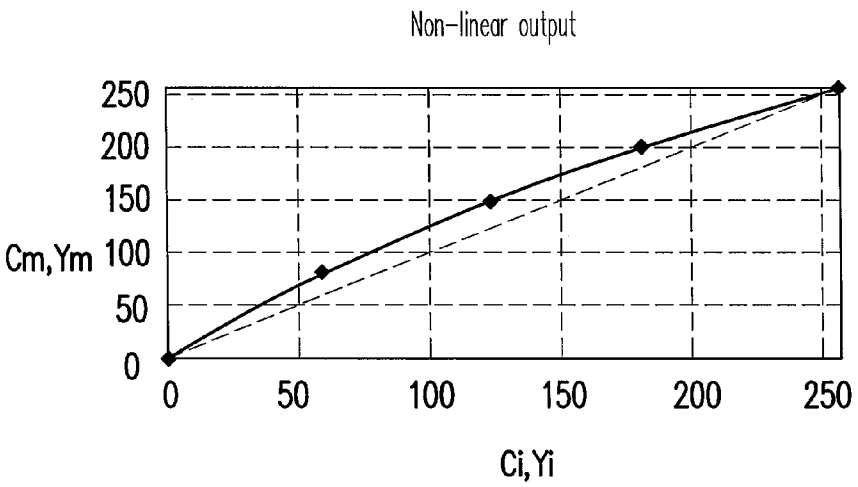

When performing the gamut mapping adjustment, six color blocks RGBCMY may be used, so that the user can view or measure the result of the color adjustment in real time. The user control interface of the gamut mapping adjustment is shown in FIG. 8. When the above first color adjustment method is applied, the user selects a color axis to be adjusted and then drags the hue scroll bar, so as to change the output hue of the color axis; the user drags the saturation scroll bar to change the output saturation of the color axis; and the user drags the brightness scroll bar to change the output brightness of the color axis. When the second and third color adjustment methods are applied, the user selects a color axis to be adjusted and then selects a brightness layer to be adjusted. The user drags the brightness scroll bar to change the output brightness of the brightness layer. The software interface related to the non-linear output lookup table is shown in FIG. 9. The user drags the non-linear adjustment points by using the mouse to produce a non-linear output curve.

The hue shift values, the saturation mapping values, the brightness transformation values and the non-linear output values of the multiple color axes, inputted by the user, are used to establish a continuous adjustment curve through a numerical method. In the embodiment, the multiple color axes are defined as at least three color axes and at most twelve color axes. The continuous adjustment curve can be established by the numerical method (such as various appropriate interpolations), and then, downloaded to the lookup table of the digital color adjustment device (i.e., achieved through software). Alternatively, the digital color adjustment device establishes the continuous adjustment curve according to the adjustment value inputted by the user (i.e., achieved through hardware). Therefore, the gamut mapping non-linear adjustment is achieved.

Figure 10A:
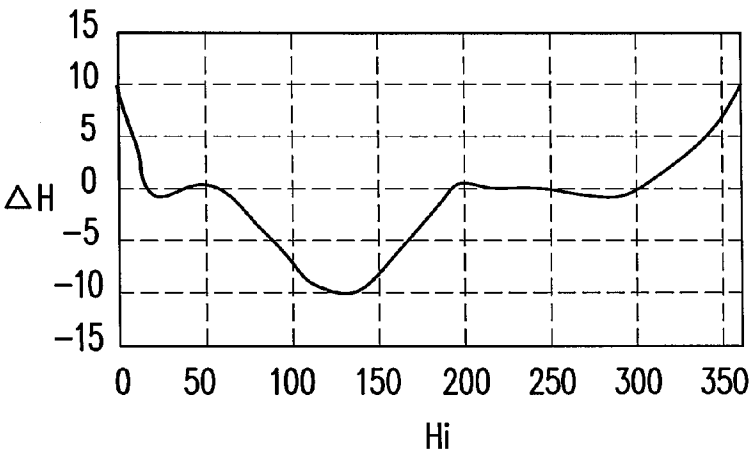
Figure 10B:
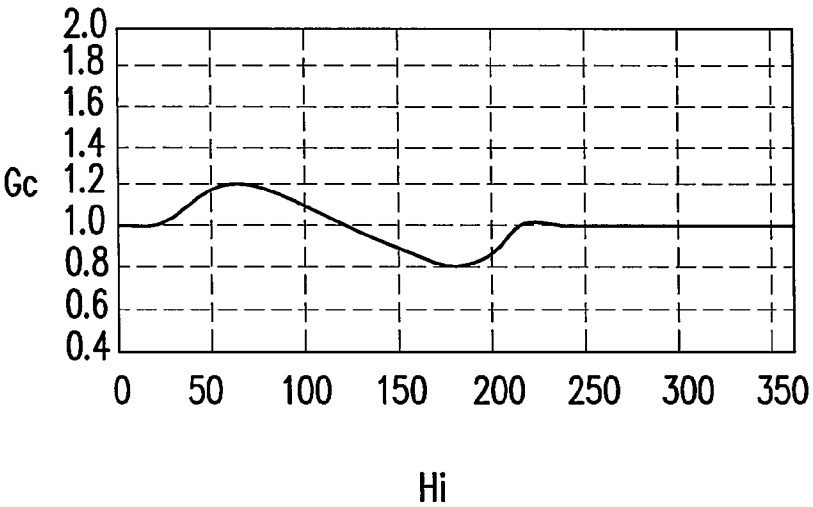
Figure 10C:
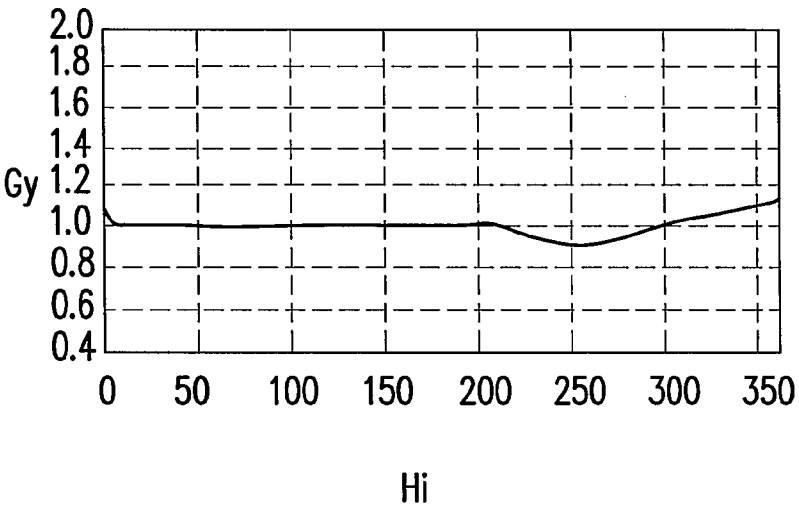
Figure 11B:
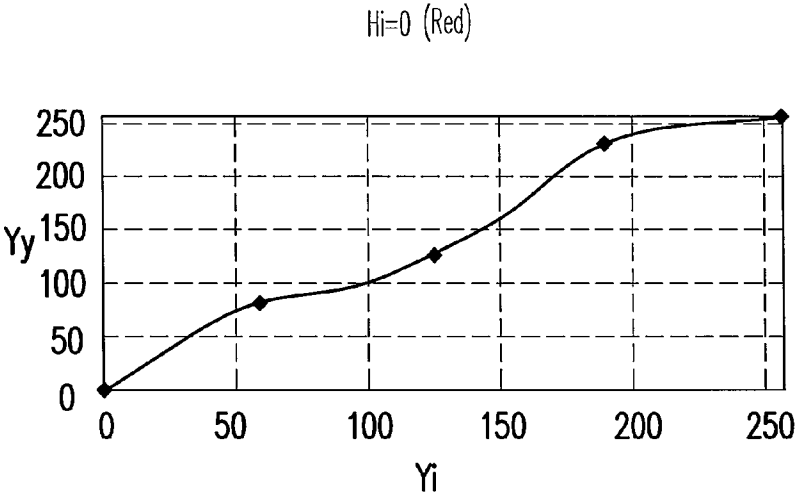
Figure 11A:
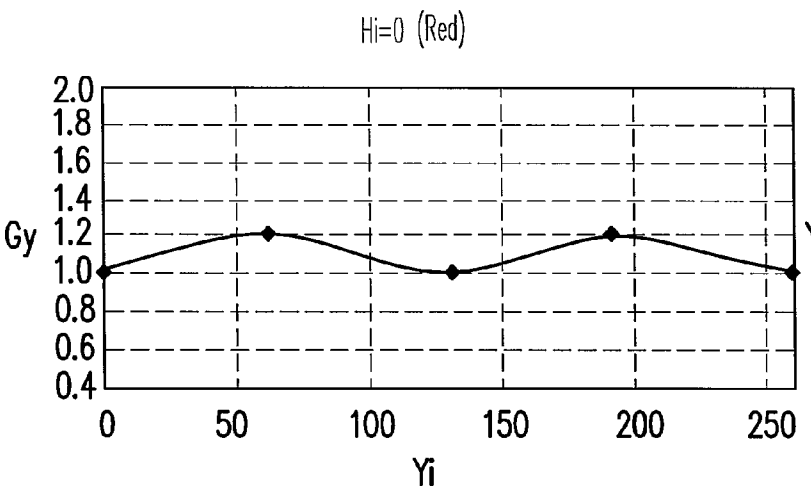

When the first color adjustment method is applied, if the user increases the red hue by 10, and reduces the green hue by 10, and increases the yellow saturation by 1.2 times and the cyan saturation by 0.8 times, and further increases the red brightness by 1.1 times and the blue brightness by 0.9 times, the established hue shift lookup table, the saturation mapping lookup table and the brightness transformation lookup table are shown in FIGS. 10*a* to 10*c*. When the second or third color adjustment methods are applied, if the use increases the brightness of the second and fourth layers of the red hue by 1.2 times, the established brightness transformation lookup table is shown in FIG. 11*a* or 11*b*.

(2) Independent Color Adjustment

Figure 13:
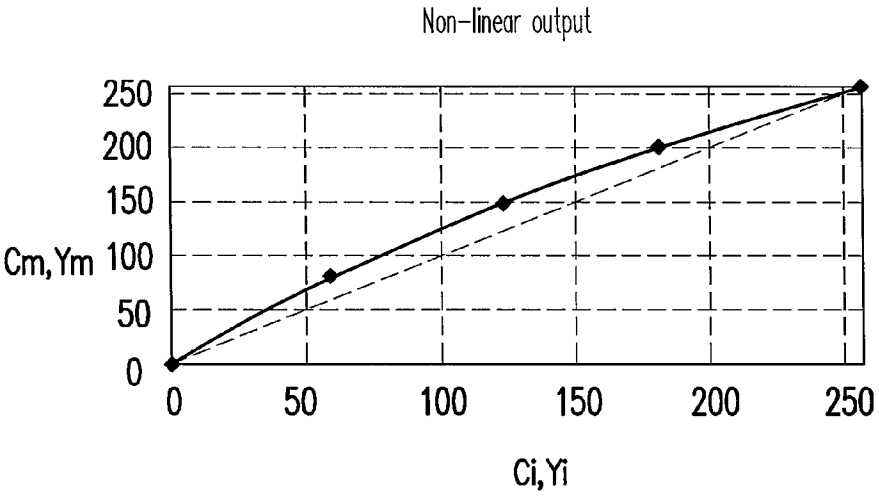

The software interface related to the independent color adjustment is shown in FIG. 12. When the first color adjustment method is applied, the user selects or newly adds an independent color to be adjusted, and then, the user drags the hue scroll bar to change the output hue of the independent color, drags the saturation scroll bar to change the output saturation of the independent color, and drags the brightness scroll bar to change the output brightness of the independent color. When the second and third color adjustment methods are applied, the user selects the independent color to be adjusted, then selects the brightness layer to be adjusted, and drags the brightness scroll bar to change the output brightness of the brightness layer. The software interface related to the non-linear output lookup table is shown in FIG. 13. The user drags the non-linear adjustment points by using the mouse to produce a non-linear output curve.

The hue shift values, the saturation mapping values, the brightness transformation values and the non-linear output values of the multiple color axes, inputted by the user, are used to establish a continuous adjustment curve through a numerical method. The continuous adjustment curve can established by the numerical method and then downloaded to the lookup table of the digital color adjustment device (i.e., achieved through software). Alternatively, the digital color adjustment device establishes the continuous adjustment curve according to the adjustment value inputted by the user (i.e., achieved through hardware). Therefore, the independent color non-linear adjustment is achieved. The independent color adjustment indicates adjustments of the hue, the saturation, and the brightness for a certain hue and the adjustment result only affects a certain range that is close to the hue.

Figure 14A:
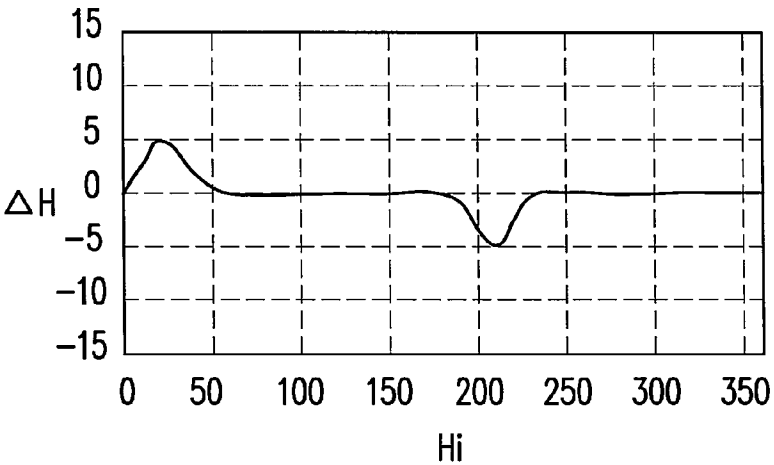
Figure 14B:
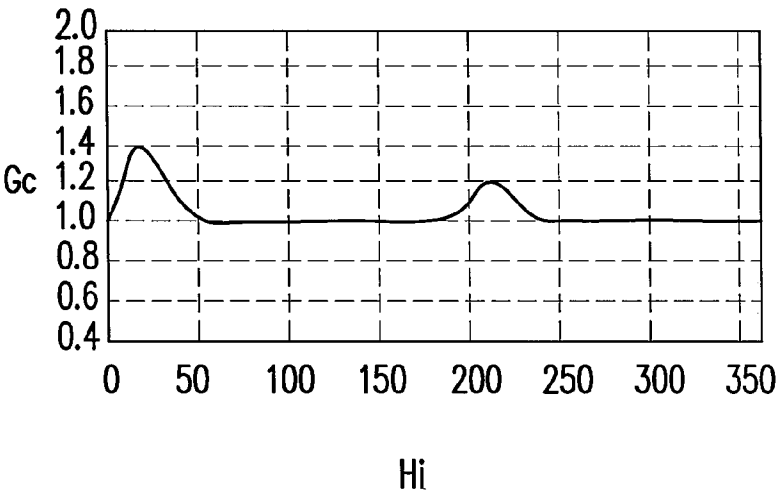
Figure 14C:
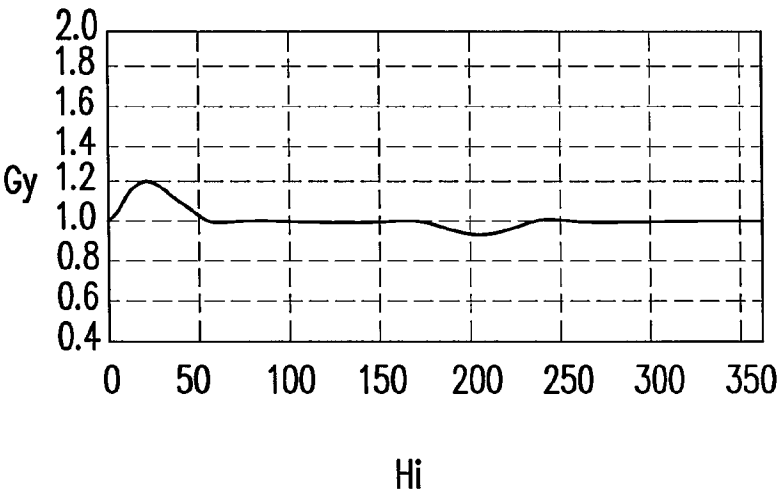
Figure 15B:
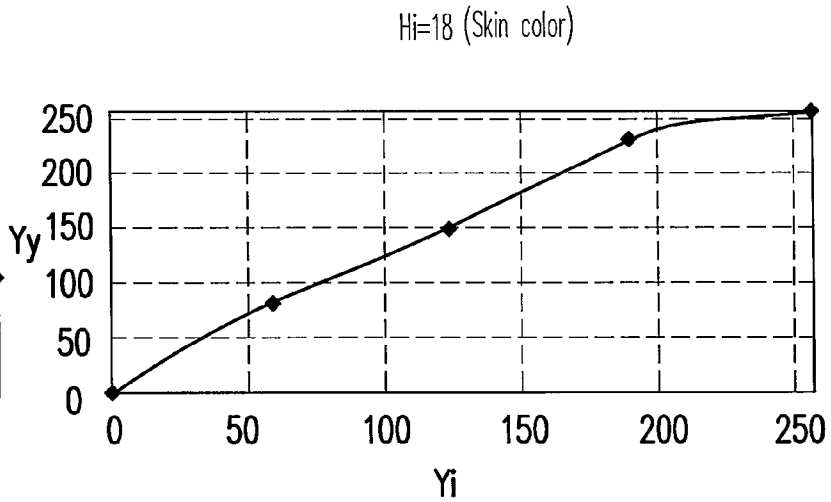
Figure 15A:
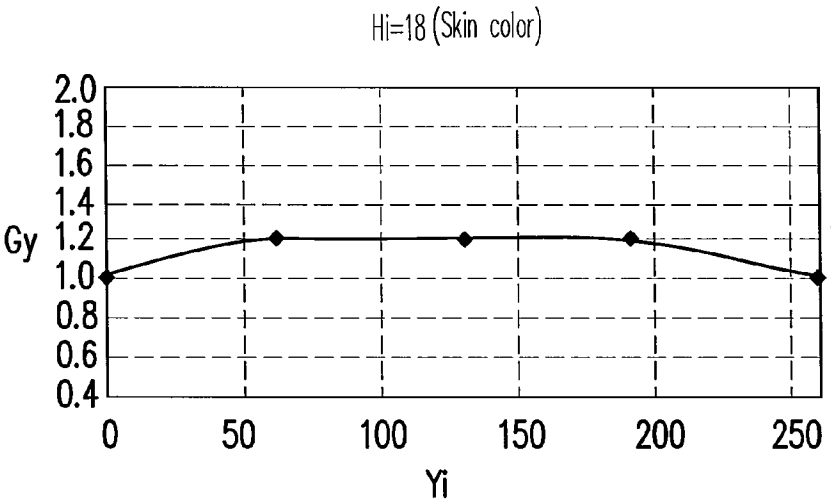
Figure 16B:
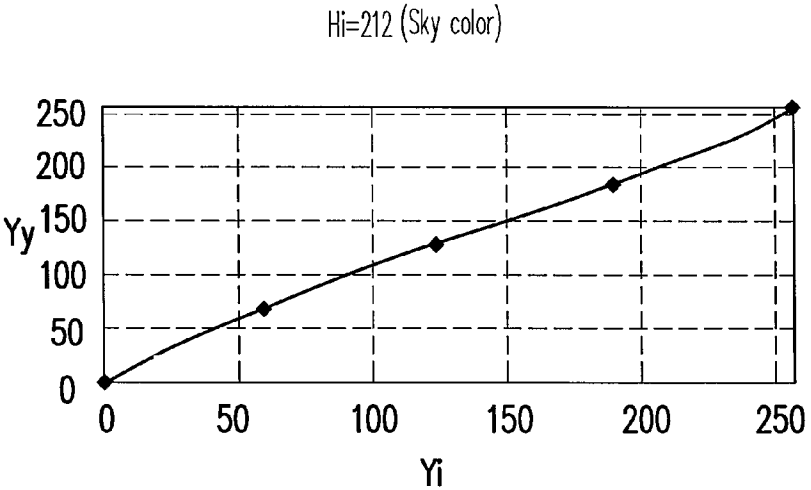
Figure 16A:
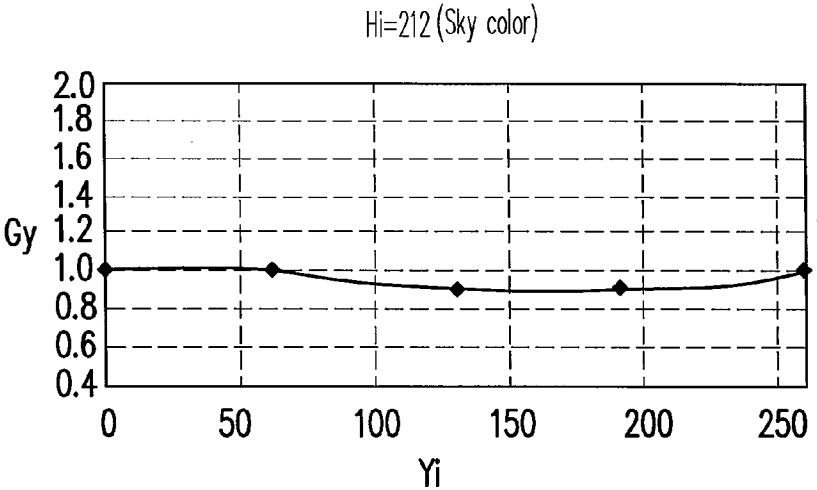

When the first color adjustment method is applied, if the user increases the hue of the skin color by 5, the saturation by 1.4 times and the brightness by 1.2 times, and reduces the hue of the sky color by 5, and increases the saturation by 1.2 times and the brightness by 0.9 times, the established hue shift lookup table, the saturation mapping lookup table and the brightness transformation lookup table are shown in FIGS. 14*a* to 14*c*. When the second or third color adjustment methods are applied, if the user increases the brightness of the second, third and fourth layers of the skin color hue by 1.2 times, the established brightness transformation lookup table is shown in FIG. 15*a* or 15*b*. When the second or third color adjustment method are applied, if the user increases the brightness of the third and fourth layers of the sky color hue by 0.9 times, the established brightness transformation lookup table is shown in FIG. 16*a* or 16*b*.

(3) Performing Both Gamut Mapping and Independent Color Adjustment at the Same Time Furthermore, both the gamut mapping and the independent color adjustment can be performed at the same time. The information such as the hue shift values, the saturation mapping values, the brightness transformation values and the non-linear output values of the multiple color axes is obtained by the software interface related to the gamut mapping adjustment as shown in FIG. 8. The information such as the hue shift values, the saturation mapping values, the brightness transformation values and the non-linear output values of the independent color adjustment is obtained by the software interface related to the independent color adjustment as shown in FIG. 12. The continuous adjustment curve can be established by a numerical method and then downloaded to the lookup table of the digital color adjustment device (i.e., achieved through software). Alternatively, the digital color adjustment device establishes the continuous adjustment curve according to the adjustment value inputted by the user (i.e., achieved through hardware). Thus, the output effect of performing the gamut mapping and independent color adjustment at the same time can be achieved.

Figure 17B:
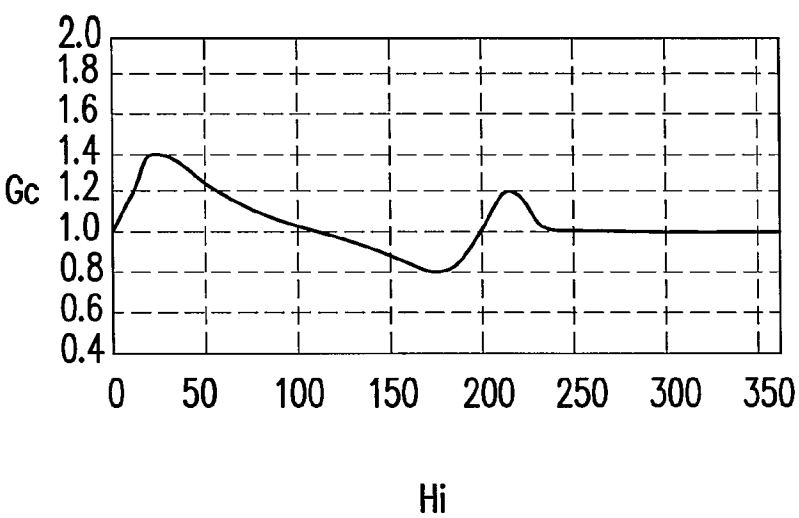
FIGS. 17*a* to 17*c* show the hue shift lookup table, the saturation mapping lookup table and the brightness transformation lookup table when performing the gamut mapping and the independent color adjustment.
Figure 17A:
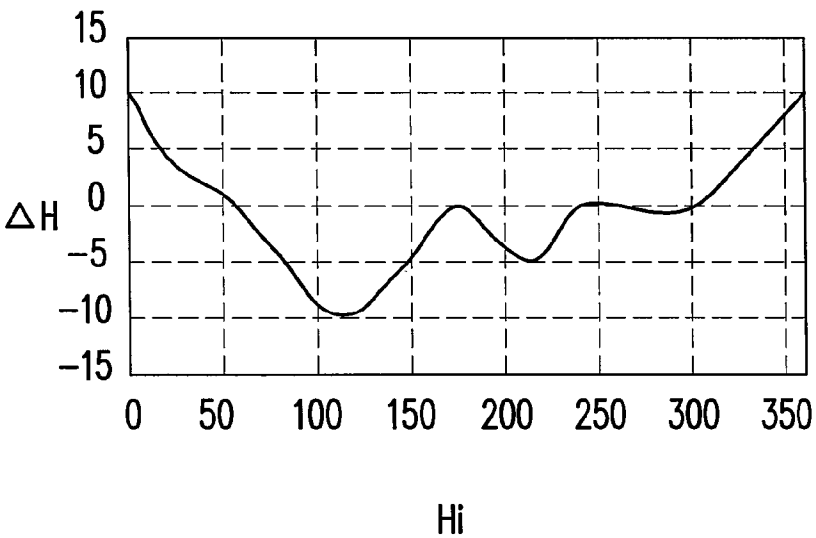
Figure 17C:
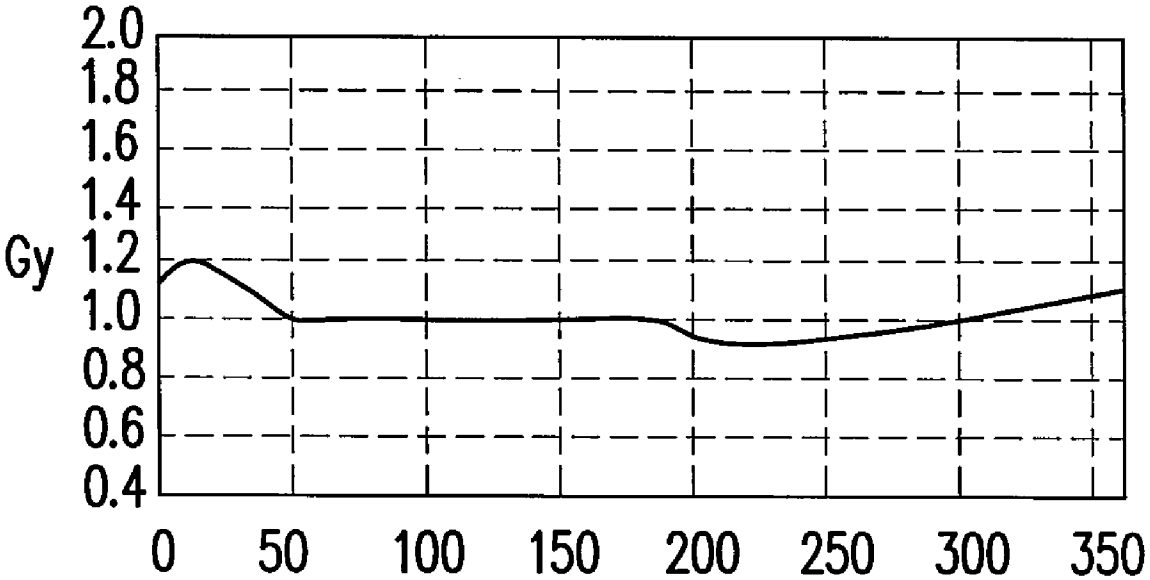

When the above first color adjustment method is applied, the established hue shift lookup table, the saturation mapping lookup table and the brightness transformation lookup table are shown in FIGS. 17*a* to 17*c*. When the above first color adjustment method is applied, the brightness transformation lookup tables established by the second or third brightness transformation lookup table are shown in FIGS. 11*a*/11*b*, FIGS. 15*a*/15*b* or FIGS. 16*a*/16*b*.

The gamut mapping non-linear adjustment and the independent color non-linear adjustment are performed separately or synchronously through the present embodiment, so as to provide an optimal and consistent output effect.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims and their equivalents.

What is claimed is:

1. A multimedia apparatus, comprising:

a driving circuit, for generating a first image color data;

a digital color adjustment device, for receiving the first image color data, the digital color adjustment device comprising:

a color transformation circuit, for receiving the first age color data and performing a color transformation on the first image color data to obtain a second image color data;

a hue transformation circuit, for receiving the second image color data and performing a hue transformation on the second image color data to obtain a third image color data comprising a hue signal, a saturation signal and a brightness signal;

a color adjustment circuit, comprising:

a hue shift lookup table, for obtaining a hue shift signal according to the hue signal;

a first adder, for adding the hue signal with the hue shift signal to obtain an adjusted hue signal;

a saturation mapping lookup table, for obtaining a saturation mapping signal according to the hue signal;

a first multiplier, for multiplying the saturation signal with the saturation mapping signal to obtain a first multiplication result;

a brightness transformation lookup table, for obtaining a brightness gain signal according to the hue signal;

a second multiplier, for multiplying the brightness signal with the brightness gain signal to obtain a second multiplication result;

a non-linear output lookup table, for obtaining a brightness upper limit signal according to the brightness signal, and for obtaining a saturation upper limit signal according to the saturation signal;

a first selecting unit, for selecting the smaller one of the saturation upper limit signal and the first multiplication result as an adjusted saturation signal; and a second selecting unit, for selecting the smaller one of the brightness upper limit signal and the second multiplication result as an adjusted brightness signal, wherein the color adjustment circuit is used for performing a color adjustment on the third image color data according to the hue shift lookup table, the saturation mapping lookup table, the brightness transformation lookup table and the non-linear output lookup table to obtain a fourth image color data;

a reverse hue transformation circuit, for receiving the fourth color data and performing a reverse hue transformation on the fourth image color data to obtain a fifth image color data; and a reverse color transformation circuit, for receiving the fifth image color data and performing a reverse color transformation on the fifth image color data to obtain a sixth image color data;

a display unit, for receiving and displaying the sixth image color data; and a user control interface, for producing an adjustment value in response to a display image displayed by the display unit, wherein the hue shift lookup table, a saturation mapping lookup table, a brightness transformation lookup table and a non-linear output lookup table are established according to the adjustment value.

2. A digital color adjustment device, for receiving a first image color data of a driving circuit, comprising:

a color transformation circuit, for receiving the first image color data and performing a color transformation on the first image color data to obtain a second image color data;

a hue transformation circuit, for receiving the second image color data and performing a hue transformation on the second image color data to obtain a third image color data comprising a hue signal, a saturation signal and a brightness signal;

a color adjustment circuit, comprising:

a hue shift lookup table, for obtaining a hue shift signal according to the hue signal;

a first adder, for adding the hue signal with the hue shift signal to obtain an adjusted hue signal;

a saturation mapping lookup table, for obtaining a saturation mapping signal according to the hue signal;

a first multiplier, for multiplying the saturation signal with the saturation mapping signal to obtain a first multiplication result;

a brightness transformation lookup table, for obtaining a brightness gain signal according to the hue signal;

a second multiplier, for multiplying the brightness signal with the brightness gain signal to obtain a second multiplication result;

a non-linear output lookup table for obtaining a brightness upper limit signal according to the brightness signal, and obtain a saturation upper limit signal according to the saturation signal;

the color adjustment circuit is used for performing a color adjustment on the third image color data according to the above lookup tables to obtain a fourth image color data;

a first selecting unit, for selecting the smaller one of the saturation upper limit signal and the first multiplication result as an adjusted saturation signal; and a second selecting unit, for selecting the smaller one of the brightness upper limit signal and the second multiplication result as an adjusted brightness signal, wherein a reverse hue transformation circuit, for receiving the fourth image color data and performing a reverse hue transformation on the fourth image color data to obtain a fifth image color data; and a reverse color transformation circuit, for receiving the fifth image color data and performing a reverse color transformation on the fifth image color data to obtain a sixth image color data.

3. A color adjustment circuit, for adjusting a hue signal, a saturation signal and a brightness signal, comprising:

a hue shift lookup table, for obtaining a hue shift signal according to the hue signal;

a first adder, for adding the hue signal with the hue shift signal to obtain an adjusted hue signal;

a saturation mapping lookup table, for obtaining a saturation mapping signal according to the hue signal;

a first multiplier, for multiplying the saturation signal with the saturation mapping signal to obtain an first multiplication result;

a brightness transformation lookup table, for obtaining a brightness gain signal according to the hue signal;

a second multiplier, for multiplying the brightness signal with the brightness gain signal to obtain an second multiplication result;

a non-linear output lookup table, for obtaining a brightness upper limit signal and a saturation upper limit signal according to the brightness signal and the saturation signal;

a first selecting unit, for selecting the smaller one of the saturation upper limit signal and the first multiplication result as an adjusted saturation signal; and a second selecting unit, for selecting the smaller one of the brightness upper limit signal and the second multiplication result as an adjusted brightness signal.

* * * * *